US005615736A

United States Patent [19]

Reed

[11] Patent Number: 5,615,736

[45] Date of Patent: Apr. 1, 1997

[54] UNITARY DIVERSIONARY-TUBING HANGER AND ENERGIZABLE ROD SEAL

[76] Inventor: Lehman T. Reed, 3219 Candlewood Dr., Bakersfield, Calif. 93306

[21] Appl. No.: 716,767

[22] Filed: Sep. 23, 1996

Related U.S. Application Data

[62] Division of Ser. No. 373,837, Jan. 17, 1995, Pat. No. 5,577,556.

[51] Int. Cl.[6] ..... E21B 33/02

[52] U.S. Cl. ..... 166/84.4; 166/84.1; 277/50; 277/74

[58] Field of Search ..... 166/84.1, 84.2, 166/84.4, 81.1; 277/37, 47, 50, 74, 79

[56] References Cited

U.S. PATENT DOCUMENTS

| | | | |
|---|---|---|---|
| 1,944,573 | 1/1934 | Raymond et al. | 166/95 X |
| 2,077,480 | 4/1937 | Humason | 166/88 |
| 2,148,360 | 2/1939 | Lemley | 166/88 |
| 2,207,255 | 7/1940 | Jesson et al. | 166/84 X |
| 2,673,615 | 3/1954 | Humason | 166/84 X |
| 2,842,386 | 7/1958 | Regan | 166/84.2 X |
| 2,889,886 | 6/1959 | Gould | 166/97.5 X |
| 3,299,958 | 1/1962 | Todd | 166/89 |
| 3,815,925 | 6/1974 | Mattoon | 166/81.1 X |
| 4,071,085 | 1/1978 | Grable et al. | 166/84 |
| 4,289,294 | 9/1981 | McLean | 166/84.4 X |
| 4,491,176 | 1/1985 | Reed | 166/65 R |
| 4,708,201 | 11/1987 | Reed | 166/65.1 |
| 4,804,045 | 2/1989 | Reed | 166/97.5 |
| 4,907,650 | 3/1990 | Heinonen | 166/84.1 X |
| 5,000,719 | 3/1991 | Reed | 166/88 |
| 5,148,865 | 9/1992 | Reed | 166/76 |
| 5,343,944 | 9/1994 | Bassinger | 166/84 |

FOREIGN PATENT DOCUMENTS

| | | | |
|---|---|---|---|
| 786613 | 11/1957 | United Kingdom | 166/75.1 |

*Primary Examiner*—Hoang C. Dang
*Attorney, Agent, or Firm*—F. Eugene Logan

[57] ABSTRACT

A simple one piece device, herein referred to as an unitary diversionary-tubing hanger, or UDTH, for attachment to a wellhead that functions as a tubing hanger, a diverter of flow from the vertical to the horizontal or visa versa, and a securing device for a removable vertical seal plug and a recoverable emergency energizable vertical rod seal. The UDTH simplifies wellhead completion by eliminating all valves in the vertical string. The UDTH can be landed directly in some wellheads. The UDTH also simplifies remedial treatment of the wellhead and can be installed or removed from most wellheads in less than one hour. The UDTH can also pass through a blowout protector attached to a wellhead. A recoverable energizable vertical rod seal, installable in the vertical passageway of the UDTH, provides an emergency pump rod seal in a wellhead completed for rod pumping, both reciprocating and rotating. The pump rod seal has a member which seal it against the vertical passageway in the UDTH, a resilient member which can be energized to seal around the pump rod when leakage occurs, while allowing the pumping to continue.

9 Claims, 11 Drawing Sheets

UNITARY DIVERSIONARY-TUBING HANGER AND ENERGIZABLE ROD SEAL

This application is a division of application Ser. No. 08/373,837, filed Jan. 11, 1995.

BACKGROUND OF THE INVENTION

It is standard practice when completing, or performing remedial work down the tubing, on wells to use of an array of valves, which are sometimes referred to as "christmas trees". Christmas tree arrays of valves on wells are generally very expensive, complicated and cumbersome. Unfortunately such arrays can experience leakage problems in each valve, or at each coupling thereto, resulting in costly and time consuming repairs. and temporary loss of production. Corrosion of the arrays can also necessitate replacement of one or more of the valves. Furthermore, care must be exercised when moving heavy equipment in an oil field not to accidentally bump into and damage the christmas tree arrays. Earthquakes can also cause damage to such arrays because of their weight and cantilevered configurations.

These christmas tree array problems were greatly alleviated by use of diversionary spool assembly ("DSA"), disclosed in my U.S. Pat. No. 4,804,045. The DSA alleviated the need for the christmas tree array of valves, however, in addition to the DSA there is a requirement for one or more additional and separable pieces to serve as a tubing hanger. Assembly of the separable tubing hanger pieces to the DSA, of course, requires time, and its presence in the string provides one or more additional separable joints which can develop leaks or other problems. Accordingly, there is an ongoing need for additional simplification to further reduce the number of component parts in wellhead operations when completing, or controlling, or performing remedial work. Separable tubing hangers are also disclosed in U.S. Pat. No. 3,299,958 and my U.S. Pat. Nos. 4,491,176 and 4,708,201 and 5,148,865. A christmas tree valve supporting assembly is also shown in U.S. Pat. No. 4,491,176.

Except for rod pump completions, when wells are completed, seal plugs are installed the vertical bore leading to the tubing string. Seal plugs are disclosed in my U.S. Pat. Nos. 4,804,045 and 5,148,645, and an expandable seal plug in my U.S. Pat. No. 5,000,719. These seal plugs, however, can not be used in rod pump completions. Accordingly, there is also a need in rod pump completions for an in-place emergency rod seal which can be used in the vertical passageway between the pump rod and the vertical passageway containing the rod, which can serve as a backup emergency seal in case of packing gland leakage around the pump rod.

SUMMARY OF THE INVENTION

This invention simplifies wellhead completion by eliminating all valves in the vertical string with the use of a simple one piece device herein referred to as an unitary diversionary-tubing hanger. The unitary diversionary-tubing hanger constitutes a single unit which is a tubing hanger, a diverter of flow from the vertical to the horizontal or visa versa, a securing means for a removable vertical seal plug and recoverable energizable vertical rod seal, and can be landed directly in the wellhead. The unitary diversionary-tubing hanger can also pass through a blowout protector attached to the wellhead.

As used herein the term "wellhead" is meant to be generic to and cover all types of wellheads including tubing heads.

Accordingly, there is provided by the principles of this invention an unitary diversionary-tubing hanger for a wellhead which simplifies completion of a well. The unitary diversionary-tubing hanger, sometimes referred to herein as "UDTH", comprises a rigid body having a top surface, a bottom surface, and a surface of revolution therebetween. The surface of revolution can be a cylindrical surface, a conical surface or a combination of cylindrical surfaces with a shoulder or shoulders therebetween, or a combination of cylindrical and conical surfaces. In general the surface of revolution is designed to fit into the wellhead to be completed or treated. Thus the surface of revolution has a predetermined configuration that is slightly smaller than the inside configuration of the wellhead and operable for removable insertion therein.

In general the UDTH has a vertically extending first passageway extending through the rigid body from the top surface to the bottom surface, a laterally extending second passageway from the surface of revolution to the first passageway, and plug securing means within the first passageway for securing a removable plug or an emergency rod seal therewithin. The second passageway is in fluid communication with the first passageway. The second passageway is a predetermined distance from the top surface and a predetermined distance from the bottom surface as determined by the wellhead. The plug securing means can be an internally threaded section within the vertical passageway or any other means, including laterally extending lock screws which engage a circumferential grove on a plug as disclosed in FIG. 3 of my U.S. Pat. No. 4,804,045, which is hereby incorporated herein by reference, namely screws 350 and plug upper portion 338. For a rod pump completion, an emergency rod seal of this invention is used. For a particular UDTH, the emergency rod seal will have the same means for securing to the vertical passageway as the vertical seal plug has. Thus the emergency rod seal and the vertical seal plug will be interchangeable for a particular UDTH. In one embodiment, the second passageway enters the first passageway below the plug securing means. In one embodiment, the UDTH further comprises means for attaching discharge valve means to the second passageway, and in a still further embodiment, the means is an internally threaded section therein extending from proximate the surface of revolution inwardly a predetermined distance towards the first passageway.

Locking means is provided on the surface of revolution located between the bottom surface and the second passageway for locking the rigid body in the wellhead. The locking means can be recessed such as a circumferential grove engageable with screws through the flange of the wellhead or tubing head, or a split ring inserted in a circumferential grove in the UDTH with a lock ring holding the split ring to the wellhead. The locking means can also be a lock ring fastened to the wellhead which engages a shoulder on the UDTH. Other means of locking the UDTH to the wellhead can also be used if desired. The locking means is spaced a predetermined distance from the second passageway and a predetermined distance from the bottom surface so that, when the UDTH is landed on the wellhead, the locking means is in operable alignment with the corresponding locking means component on the wellhead.

Sealing means is also provided on the surface of revolution located between the bottom surface and the locking means for sealing the rigid body in the wellhead and to prevent leakage through the space between the surface of revolution of the UDTH and the wellhead. Therefore the first sealing means is for sealing the annular space between the rigid body and the opposing inside surface of the wellhead. The sealing means can be one or more circumferential O-ring grooves in the surface of revolution, each of which holds a resilient O-ring, or any other type of seal. In general, the first sealing means is spaced a predetermined distance from the bottom surface and a predetermined distance from the locking means.

In general, the UDTH also comprises integral tubing hanger means in the bottom of, and in fluid communication with, the first passageway and axially aligned therewith for hanging tubing therefrom. An example of tubing hanger means is an internally threaded section in the bottom portion of the first passageway into which the tubing is screwed. Therefore, in this invention, tubing is installed in the UDTH, and then the UDTH is landed in the wellhead. Thus in this invention it is not necessary to connect the tubing to separate tubing hanger means and then couple the diversionary spool assembly as in my U.S. Pat. No. 4,804,045, or other intermediate pieces, to the tubing hanger means.

The UDTH can also comprises upper coupling means in the top of, and in fluid communication with, the first passageway and axially aligned therewith for removably coupling a device to the rigid body. Examples of such devices are secondary backup seals, bull plugs, standby service valves with lubricators and any other device useful for treating or providing remedial services to the wellhead.

The UDTH can also have a sealing surface on the rigid body for seating the UDTH on an opposing seating surface within the wellhead so that when the UDTH is landed in the wellhead the seating surface lands on a corresponding seating surface in the wellhead.

In one embodiment, the first passageway has a bottom portion and an upper portion, and the second passageway is in fluid communication with the bottom portion, and the plug securing means is in the upper portion. In another embodiment, the second passageway is spaced about midway between the top surface and the bottom surface. In a further embodiment, the bottom portion has a first section having a first inside diameter, and the upper portion has a second section having a second inside diameter larger than the first inside diameter and coaxial therewith. An annular transition section is provided between the first and second sections. In a still further embodiment, the upper portion of the first passageway has a third section having a third inside diameter larger than the second inside diameter and coaxial therewith. The second section is located between the first and third sections, and the plug securing means is in the third section. In this embodiment, the sealing means of the plug securing means, or the emergency rod seal, seals against the second section of the first passageway or vertical passageway. In yet a further embodiment, the upper portion of the first passageway has a fourth section having a fourth inside diameter larger than the third inside diameter and coaxial therewith. The third section is between the second and fourth sections. In one embodiment, the upper coupling means is in the fourth section.

One embodiment of this invention further comprises at least one laterally extending small passageway from the surface of revolution to the first passageway for injection of a sealant. The small passageway is between the plug securing means and the second passageway and is spaced a predetermined distance from the plug securing means and a predetermined distance from the second passageway.

There is also provided by the principles of this invention a removable emergency pump rod seal assembly for installation in the first passageway of the UDTH, and for sealing, in an emergency, the annular space between the first passageway and a pump rod. The removable rod seal assembly has a separable first part and a separable second part.

The separable first part has an outer cylindrical surface having a diameter slightly smaller than the diameter of the first passageway or vertical passageway of the rigid body, outer sealing means on the outer cylindrical surface for sealing the annular space between the separable first part and the first passageway, a vertically extending cylindrical bore concentric with the outer cylindrical surface for installing the pump rod therethrough, and resilient energizable inner sealing means for sealing, in an emergency, the space between the vertically extending cylindrical bore and the pump rod. The separable second part has an assembly securing means for securing the separable second part to the plug securing means of the first passageway, and means for installing and retrieving the removable rod seal assembly, in and from, the first passageway of the UDTH. The emergency rod seal also has means for rotatably connecting the separable second part to the separable first part, and a vertically extending cylindrical bore for installing a pump rod therethrough. The vertically extending cylindrical bore of the separable second part is concentric with the vertically extending cylindrical bore of the separable first part.

In a further embodiment, the UDTH further comprises a vertically extending third passageway within the rigid body and extending therethrough from the top surface to the bottom surface of the rigid body. The third passageway is not in fluid communication with the first and second passageways. This passageway can be used for auxiliary downhole functions such as installation of an electric submersible pump, or completions for water flood or closed system single hydraulics production. If desired additional independent vertical passageways can be provided in the UDTH for various other purposes useful in well treatment, remedial work or operation. Thus this invention is not limited to one or two independent vertical passageways but includes several vertical passageways limited only by the size and space available at the wellhead.

In one embodiment, the bottom portion of the first passageway includes an internally threaded section for receiving a removable plug. This embodiment is useful where regulations or policy require provisions for plug installation below the horizontal line. In this embodiment the plug can also be installed through the top of the vertical passageway.

In this invention the UDTH can be passed through a blowout protector mounted on the wellhead since the maximum outside diameter of the rigid body of the UDTH is small enough to allow the rigid body to pass through the blowout protector secured to the wellhead.

In a further embodiment of this invention there is also provided a removable energizable vertical rod seal for removable installation of a pump rod therethrough for use in a vertical passageway of a member connected to a wellhead. The removable energizable vertical rod seal comprises a separable first part and a separable second part.

The separable first part comprises a first annular member having a top, a bottom, a first outer cylindrical section for removable installation in the vertical passageway of the member, and a first inner cylindrical section or bore concentric with the first outer cylindrical section for removable installation of the pump rod therethrough. The separable first part also comprises outer sealing means on the first outer cylindrical section for sealing the space between the separable first part and the vertical passageway of the member, a seating surface on the first annular member for seating on an opposing seating surface in the vertical passageway of the member, and a seal cavity within the separable first part having a circumferential inner opening to the first inner cylindrical section or bore, and at least one laterally extending passageway from the first outer cylindrical section to the seal cavity. The separable first part includes removable energizable resilient inner sealing means housed in the seal cavity for sealing, when energized, the space between the separable first part and the pump rod installed therethrough.

The separable second part of the recoverable energizable vertical rod seal comprises a second annular member having a top, a bottom, a second outer cylindrical section for removable installation in the vertical passageway of the member, and a second inner cylindrical section or bore concentric with the second outer cylindrical section for removable installation of the pump rod therethrough. The separable second part also comprises means for rotatable attachment of the bottom of the separable second part to the top of the separable first part with concentric alignment of the first outer cylindrical section with the second outer cylindrical section, and means, on the second outer cylindrical section, for removable attachment of the separable second part to the vertical passageway of the member. The separable second part includes means for removable attachment of a device to the top of the separable second part for facilitating removable installation of the removable energizable vertical rod seal into the vertical passageway of the member. Therefore, when the removable energizable vertical rod seal is installed in the vertical passageway of the member, the separable first part is non-rotatably installed therein.

In one embodiment, the outer sealing means comprises a circumferential groove on the first outer cylindrical section for retaining an O-ring seal.

In another embodiment, the seal cavity has an elongated annular shape concentric with the first outer cylindrical section. In still another embodiment, the removable energizable resilient inner sealing means has a shape designed to fill the seal cavity and the circumferential opening and to remain, until energized, spaced away from the pump rod.

In one embodiment, the means for removable attachment of a device to the top of the separable second part is a inverted T-slot.

In one embodiment, the first annular member comprises an upper member and a lower member which are removably joined and when separated provide access to the seal cavity. In this embodiment, the upper member comprises the first outer cylindrical section, the top, the outer sealing means, and the seating surface. The upper member and lower member are removably joined by an internally threaded section and an externally threaded section. In a further embodiment, the upper member comprises the internally threaded section and the lower member comprises the externally threaded section, and there is also provided sealing means for preventing fluid communication between the upper member and the lower member.

In one embodiment, the means for removable attachment of the separable second part to the vertical passageway of the member is an externally threaded section. In another embodiment, the means for removable attachment of the separable second part to the vertical passageway of the member is a circumferential grove for receiving laterally extending locking screws deployed through the wellhead.

BRIEF DESCRIPTION OF THE DRAWINGS

FIG. 1, is an illustration of a first embodiment of an unitary diversionary-tubing hanger of this invention assembled with tubing, a vertical seal plug and a bull plug.

FIG. 2 illustrates usage of a second embodiment of an unitary diversionary-tubing hanger in a tubing head completed for reciprocating or rotating rod pump production.

FIG. 3 illustrates usage of a third embodiment of an unitary diversionary-tubing hanger of FIG. 2 in a tubing head completed for free flow production.

FIG. 4 illustrates usage of a fourth unitary diversionary-tubing hanger of this invention having a lower tapered conical surface installed in a tubing head completed for free flow production.

FIG. 5 illustrates usage of a fifth unitary diversionary-tubing hanger having a shoulder surface ready to run through a blowout protector and land in a tubing head.

FIG. 6 illustrates usage of the unitary diversionary-tubing hanger of FIG. 5 with the shoulder surface abutting a lock ring and installed in a tubing head completed for free flow production.

FIG. 7 illustrates usage of a sixth unitary diversionary-tubing hanger of this invention having two vertical passageways installed in a tubing head completed for reciprocating or rotating rod pump production with one of the vertical passageways having its ends sealed with removable plugs.

FIG. 8 is a detail of the top portion of the unitary diversionary-tubing hanger of FIG. 7 taken through line 8—8.

FIG. 9 illustrates usage of the unitary diversionary-tubing hanger of FIG. 7 in a tubing head completed for electric submersible pump production.

FIG. 10 is a detail of the top portion of the unitary diversionary-tubing hanger of FIG. 9 taken through line 10—10.

FIG. 11 illustrates usage of the unitary diversionary-tubing hanger of FIG. 7 in a tubing head completed for water flood or closed system single hydraulics production.

FIG. 12 is an illustration of one embodiment of a retrievable non-rotating vertical rod seal of this invention with an energizable seal member.

FIG. 13 is an explosive view of the component parts of the recoverable energizable vertical rod seal of FIG. 12.

FIG. 14 illustrates usage of the first embodiment of unitary diversionary-tubing hanger of FIG. 2 in a tubing head completed for reciprocating or rotating rod pump production using the retrievable non-rotating vertical energizable rod seal of FIG. 12.

FIG. 15 illustrates usage of the sixth unitary diversionary-tubing hanger similar to that of FIG. 7, installed in a tubing head completed for reciprocating or rotating rod pump production using the retrievable non-rotating energizable vertical rod seal of FIG. 12 with one of the vertical passageways having an electrical connector installed therein.

FIG. 16 is a detail of the top portion of the unitary diversionary-tubing hanger of FIG. 15 taken through line 16—16.

DESCRIPTION OF THE PREFERRED EMBODIMENTS

Figure 1:
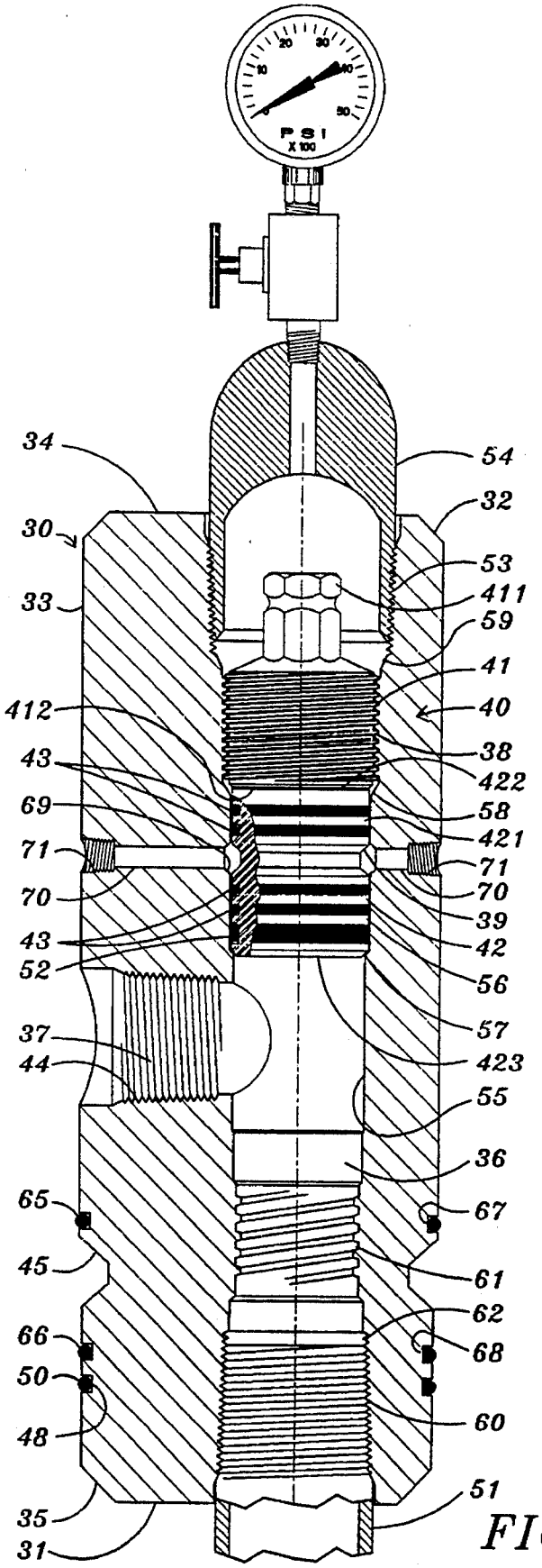
FIGS. 1–16 are elevational cross-sectional views.
Figure 2:
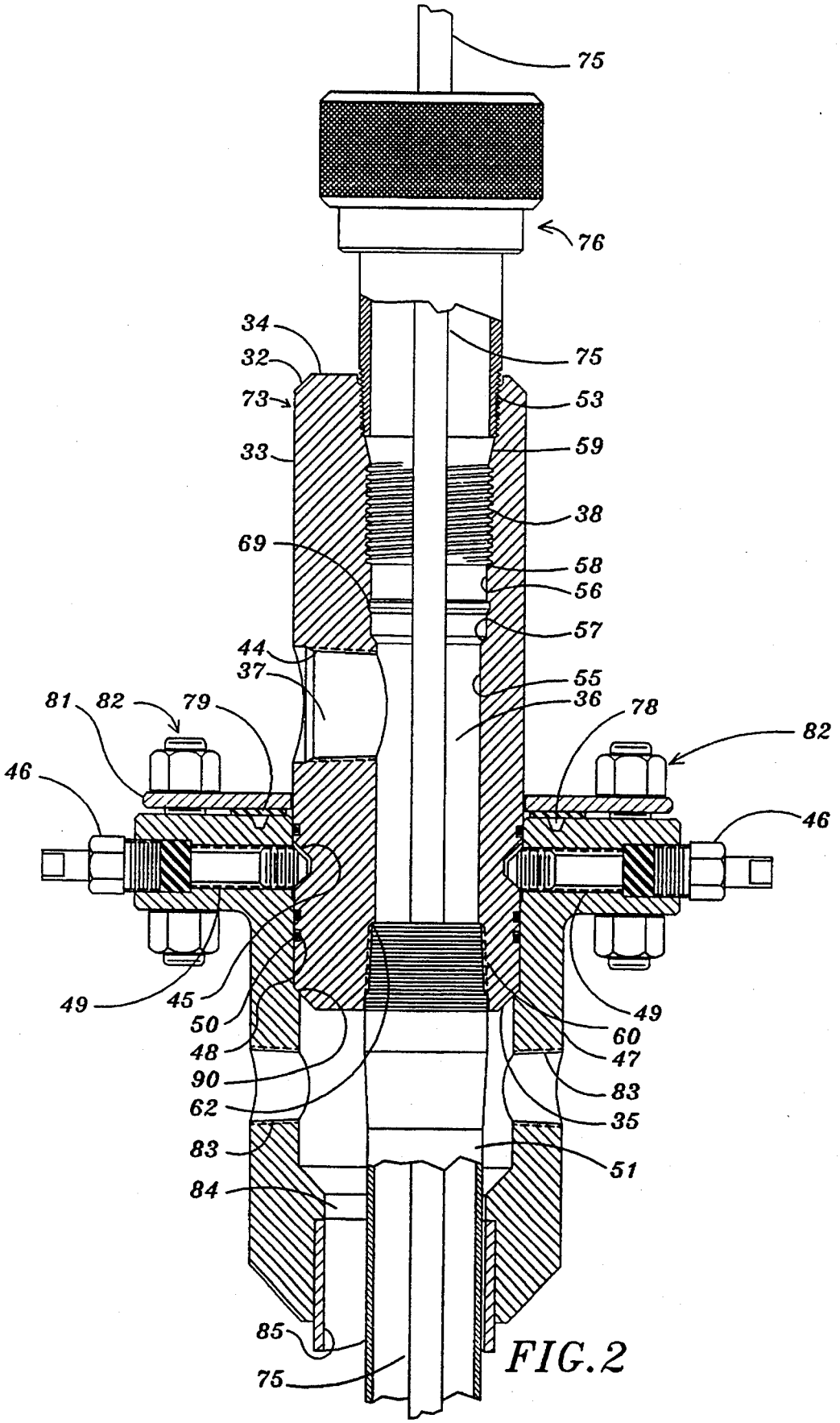
Figure 3:
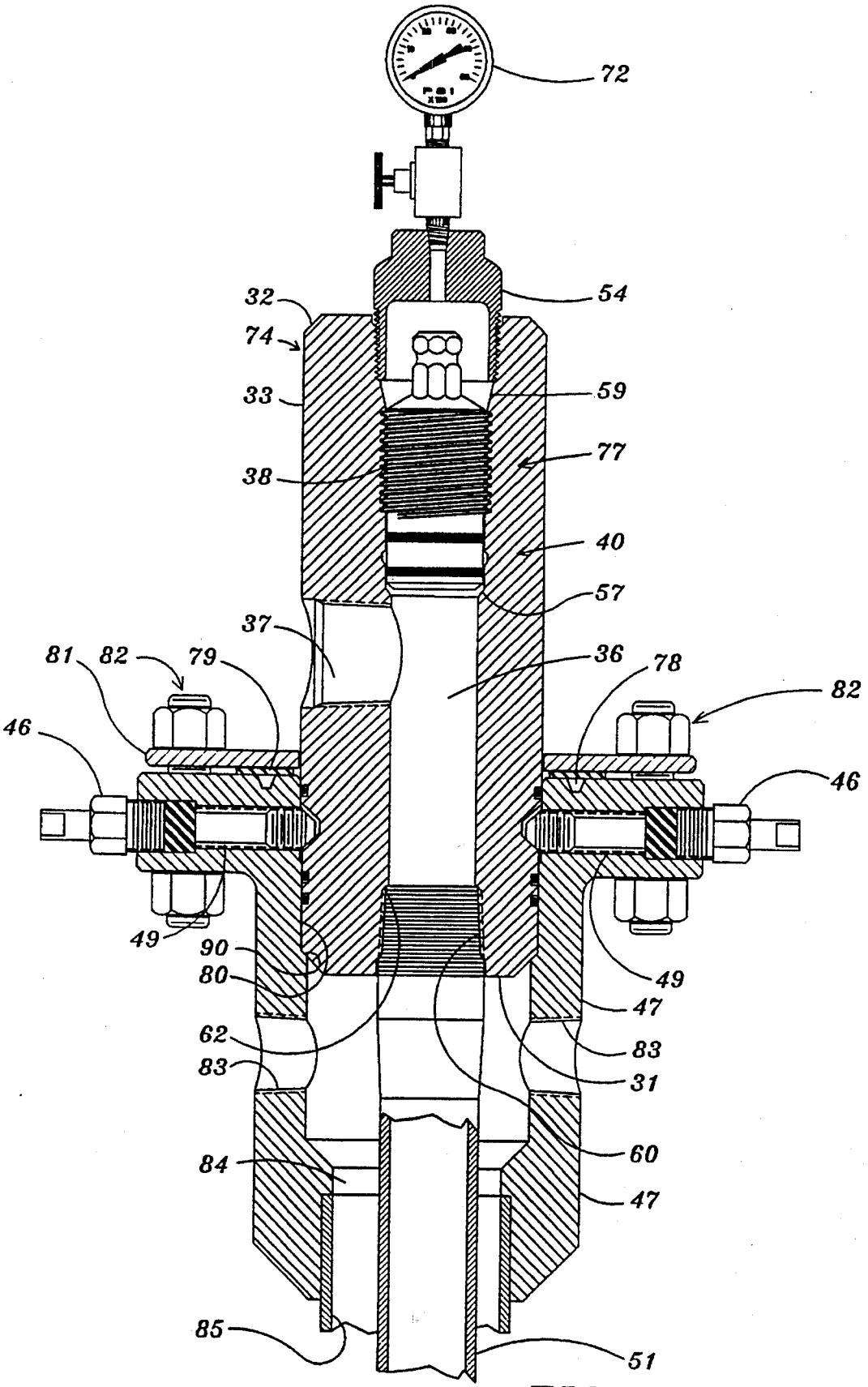

In the figures, like element nos. are employed to designate like parts. With reference to FIG. 1, there is shown a first embodiment 30 of an unitary diversionary-tubing hanger of this invention for use in wellheads, some of which uses are illustrated in FIGS. 2 and 3. In embodiment 30 the unitary diversionary-tubing hanger comprises rigid body 32 having cylindrical surface 33, top surface 34, bottom surface 31 and bottom seating surface 35. A vertically extending first passageway 36 extends through rigid body 32, and a laterally extending second passageway 37 extends from the cylindrical surface 33 into the first passageway 36. Internally threaded section 38 provides plug securing means within passageway 36 for securing removable two piece vertical seal plug assembly 40 therewithin. Plug assembly 40 comprises separate upper externally threaded piece 41 having hex head 411 and bottom surface 412, and separate lower piece 42 having top surface 422, bottom surface 423, O-ring seals 43 and lip-type seal 52 held in separated circumferential groves on cylindrical surface 421.

The outer portion of second passageway 37 contains internally threaded section 44 for attachment of a valve (not shown in the figures) thereto for controlling and/or shutting off flow from the wellhead. Circumferential V-grove 45 on cylindrical surface 33, located between bottom seating surface 35 and second passageway 37, and locking screws 46 in internally threaded laterally extending holes 49 in wellhead flange, provide locking means for locking the rigid body 32 in wellhead 47 as illustrated in FIGS. 2 and 3. Circumferential O-ring groove 48 in cylindrical surface 33 located between bottom seating surface 35 and V-grove 45, with O-ring 50 provide sealing means for sealing rigid body 32 in wellhead 47. The bottom portion of vertical passageway 36 contains internally threaded section 60 which provides means for hanging tubing 51 therefrom. Internally threaded section 60 is in fluid communication with, and axially aligned with, the first passageway 36. An internally threaded section 53 in the upper portion of first passageway 36 provides upper coupling means for removably coupling a device of choice to rigid body 32. In FIG. 1 the device of choice shown is bull plug 54, however, other devices useful in wellhead operations can be coupled in a similar manner. Examples of such devices are packing glands assemblies for reciprocating and rotating rod pumps, standby service valves with lubricators, and means for retrieving the unitary diversionary-tubing hanger. Internally threaded section 53 is in fluid communication with and axially aligned with the first passageway 36.

In embodiment 30, vertical passageway 36 has first inside diameter section 55 extending predetermined distances above and below second passageway 37; second inside diameter section 56, separated from first inside diameter section 55 by shoulder 57, extends a predetermined distance above shoulder 57; internally threaded section 38, separated form second inside diameter section 56 by transition section 58, extends a predetermined distance above section 58; and internally threaded section 53, separated from internally threaded section 38 by transition section 59, extends a predetermined distance above section 59. The diameter of internally threaded section 53 is larger than the diameter of internally threaded section 38, which is larger than the diameter of second inside diameter section 56, which is larger than the diameter of first inside diameter section 55.

In FIG. 1, the diameter of internally threaded section 60 of vertical passageway 36 is larger than the diameter of first inside diameter section 55. If desired, a portion of first passageway 36 can contain internally threaded section 61 having a diameter smaller than the diameter of first inside diameter section 55. Internally threaded section 61 is for installing a second plug (not shown in the figures) therein below second passageway 37. Both plug assembly 40 and the second plug can be installed through the top of the unitary diversionary-tubing hanger. The disadvantage of having internally threaded section 61 is its choking effect to the flow from the well. Therefore, some well operators may prefer not to have internally threaded section 61 in first passageway 36 and in such cases internally threaded section 60 is separated from first inside diameter section 55 merely by transition section 62 as shown in FIGS. 2 and 3.

To improve the seal between rigid body 32 and wellhead 47, the unitary diversionary-tubing hanger further comprises second O-ring 65 on cylindrical surface 33 located between second passageway 37 and the groove 45, and auxiliary O-ring 66 on cylindrical surface 33 located between groove 48 and groove 45. O-rings 65 and 66, which are identical to O-ring 50, are held in circumferential O-ring grooves 67 and 68, respectively, which are identical to groove 48.

The unitary diversionary-tubing hanger of FIG. 1 also has two opposing radially extending bores 70 with internally threaded sections 71. Bores 70 communicate with circumferential channel 69 which together with an opposing circumferential channel 39 in plug 40 provide a path for injecting a sealant around plug piece 42 in case a fluid leakage occurred past vertical seal plug assembly 40. A leak can be detected by a build up of pressure sensed by gage 72. Internally threaded sections 71 are sealed with conventional flush plugs to run through the blow out preventor (not shown in the FIGS. 1–3).

FIG. 2 illustrates usage of a second embodiment 73 of an unitary diversionary-tubing hanger in tubing head 47 which has been completed for reciprocating or rotating rod pump production. The rigid body 32 of embodiment 73 is the same as rigid body 32 of FIG. 1 except that internally threaded section 61 of FIG. 1 is not provided for in first passageway 36 of FIG. 2, and tubing 51 is larger in FIG. 2 than it is in FIG. 1. The lower portion of cylindrical surface 33 below second passageway 37 faces opposing concave inside surface 80 of wellhead 47, and bottom seating surface 35 of rigid body 32 rests on opposing seating surface 90 of wellhead 47. Highly polished pump rod 75, powered by a reciprocating or rotating rod pump (not shown in the figure), is installed through packing gland assembly 76 which is coupled to internally threaded section 53.

FIG. 3 illustrates usage of a third embodiment 74 of the unitary diversionary-tubing hanger in tubing head 47 which has been completed for free flow production with conventional vertical seal plug 77 installed in internally threaded section 38 of rigid body 32. The rigid body 32 of embodiment 74 is the same as rigid body 32 of FIG. 1 except that internally threaded section 61 of FIG. 1 is not provided in first passageway 36 of FIG. 3.

Wellheads 47 of FIGS. 2 and 3 are of conventional design and contain circular V-grove 78 for mounting a standby service valve with lubricator (not shown in the figure), gasket 79 for protecting groove 78, gasket protector plate 81, and bolting means 82 for securing plate 81 to wellhead 47. Conventional laterally extending internally threaded holes 83 permit access to annular space 84 between tubing 51 and wellbore 85.

Figure 4:
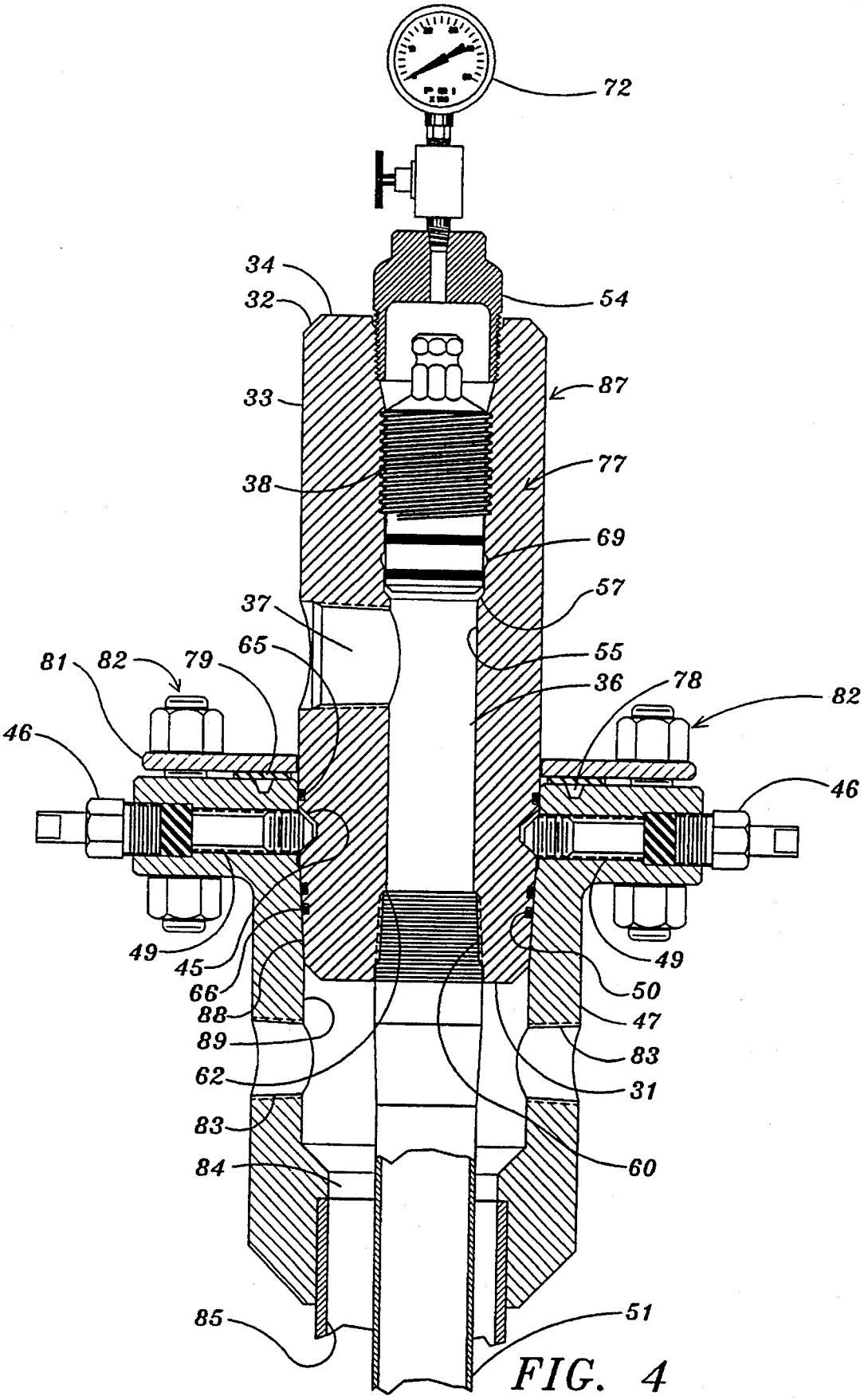

FIG. 4 illustrates usage of a fourth embodiment 87 of an unitary diversionary-tubing hanger installed in a tubing head 47 which has been completed for free flow production. The rigid body 32 of embodiment 87 has a lower tapered male conical surface 88 which matches a corresponding opposing concave conical surface 89 in tubing head 47.

Figure 6:
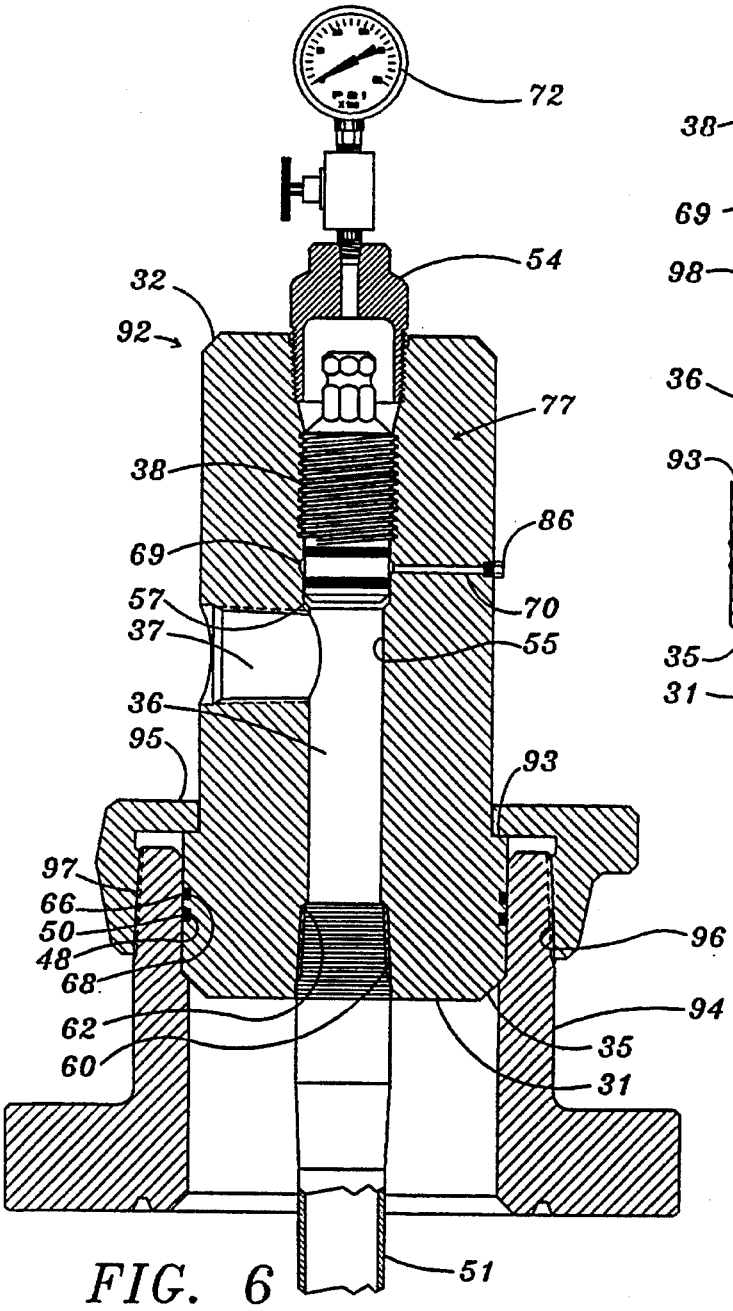
Figure 5:
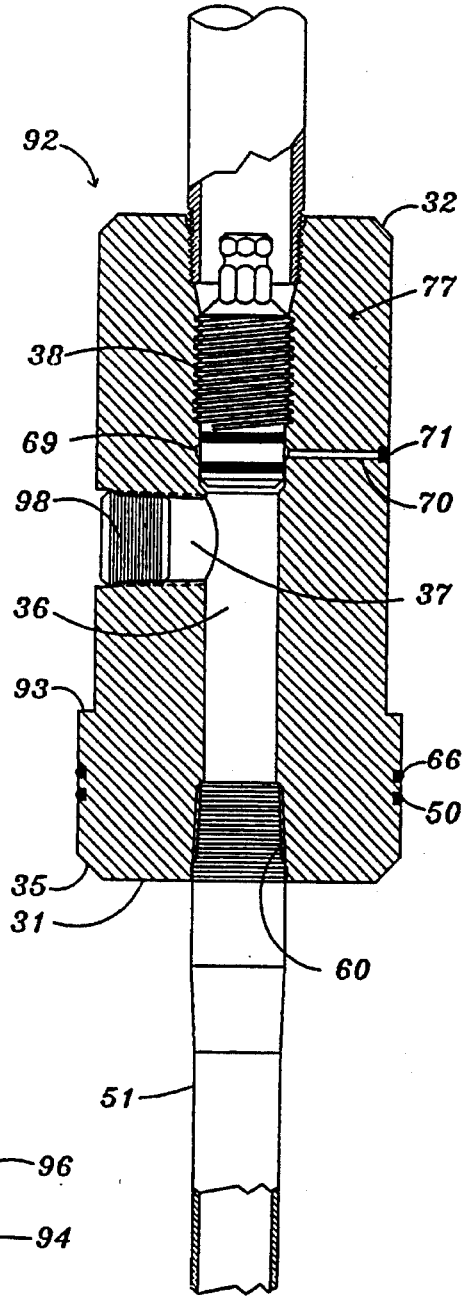

FIG. 5 illustrates usage of a fifth embodiment 92 of an unitary diversionary-tubing hanger ready to run through a blowout protector and land in a tubing head 94 shown in FIG. 6. FIG. 6 illustrates usage of the unitary diversionary-tubing hanger of FIG. 5 with shoulder surface 93 abutting lock ring 95. Lock ring 95 has internally threaded section 96 for screwing onto externally threaded section 97 of wellhead 94. Wellhead 94, with flush plug 98 removed from passageway 37, is shown completed for free flow production.

Figures 7, 8:
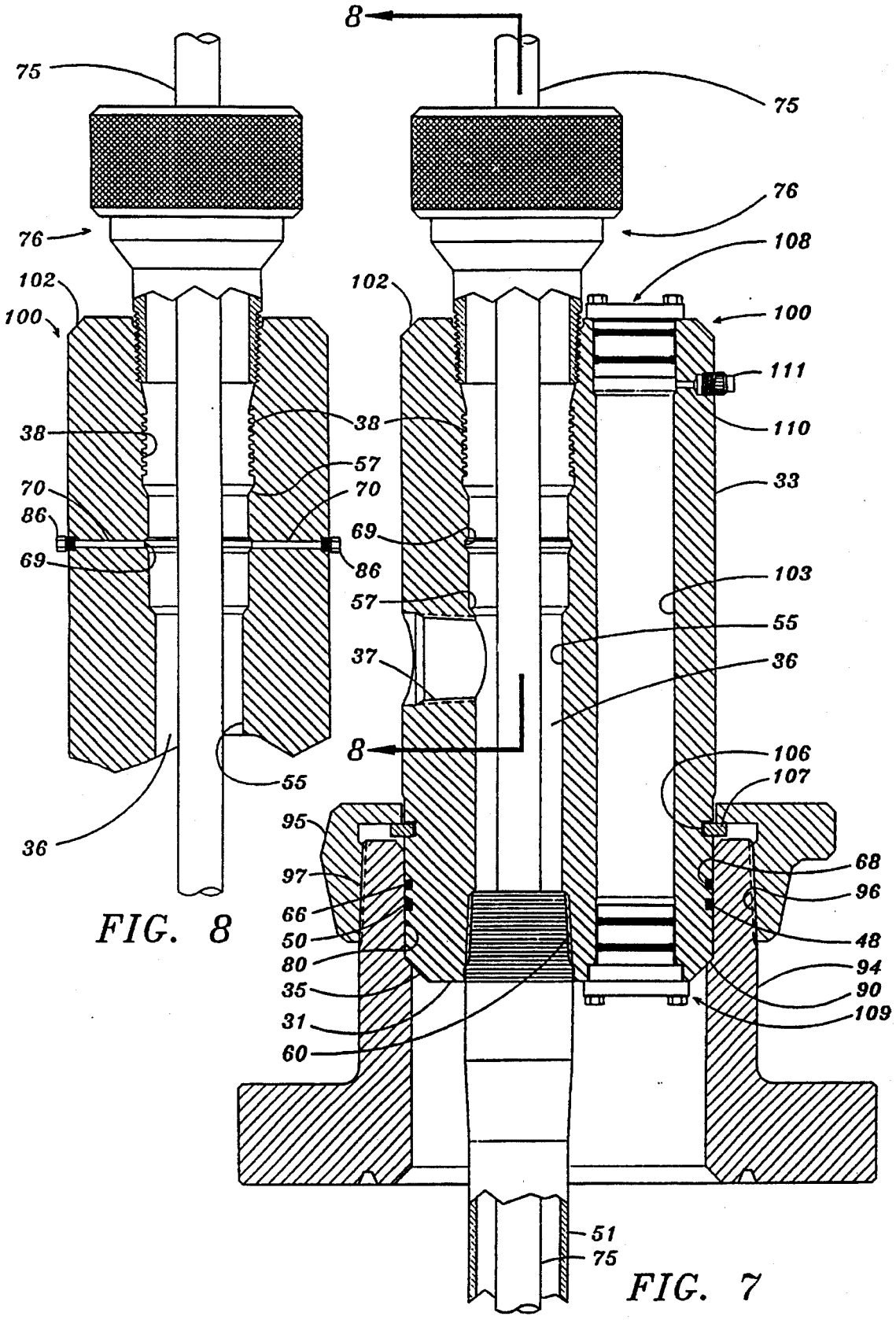

FIG. 7 illustrates usage of a sixth embodiment 100 of an unitary diversionary-tubing hanger with a rigid body 102 having two vertical passageways 36 and 103. As shown in FIG. 7, wellhead 94 has been completed for reciprocating or rotating rod pump production with second vertical passageway 103 having removable upper and lower plug assemblies 108 and 109, respectively, installed therein. Rigid body 102 has a circumferential grove 106 for receiving split ring 107, which is held down by lock ring 95. A small laterally extending internally threaded passageway 110, shown sealed with plug 111, from cylindrical surface 33 to second vertical passageway 103 is provided for assess thereto. FIG. 8 is a detail of the top portion of the unitary diversionary-tubing hanger of FIG. 7 taken through line 8—8 of FIG. 7 to show small bores 70 which are sealed with small plugs 86.

Figures 9, 10:
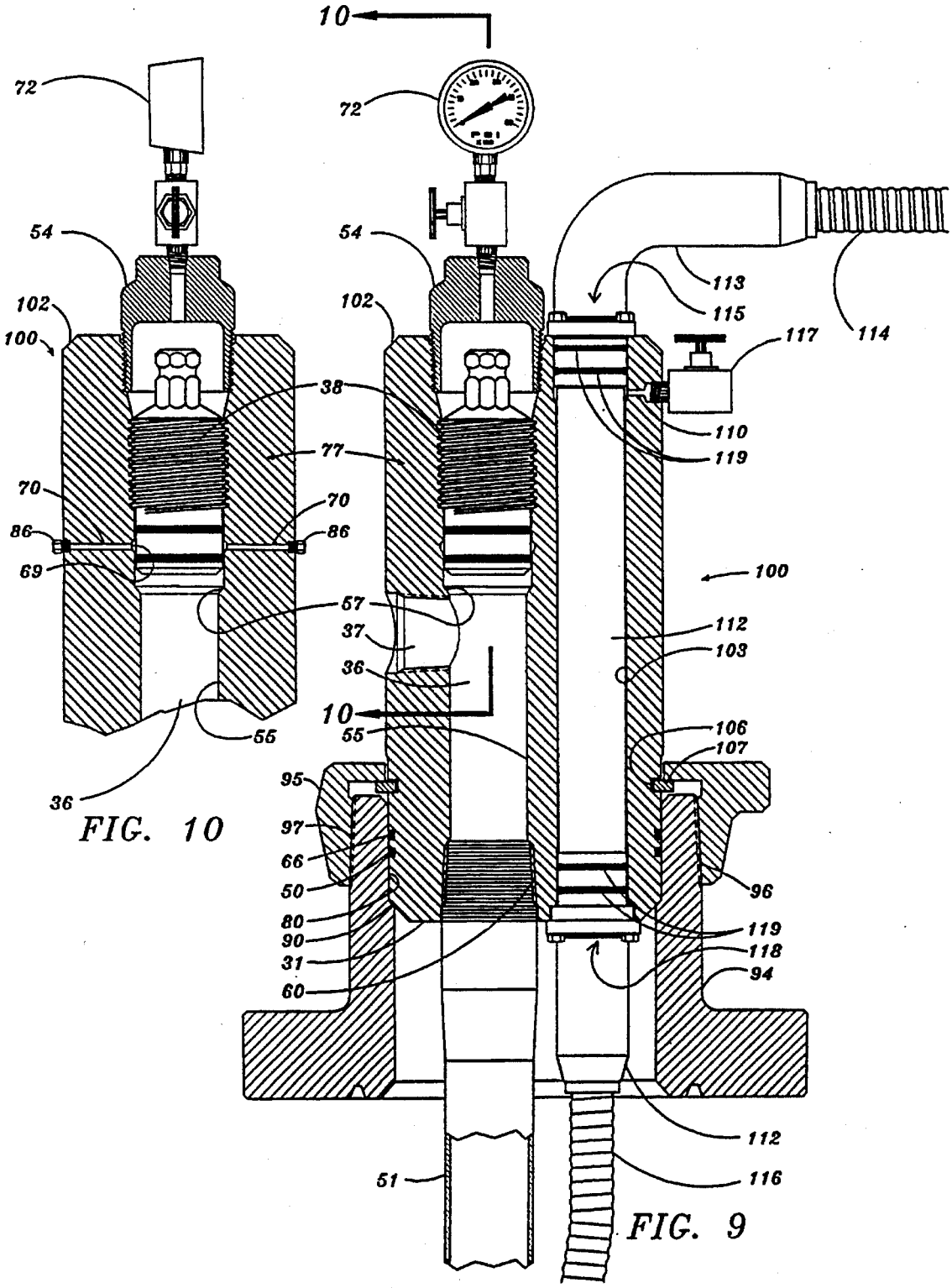

FIG. 9 illustrates another usage of sixth embodiment 100 of the unitary diversionary-tubing hanger in wellhead 94 which has been completed for electric submersible pump production. Lower plug assembly 109 of FIG. 7 has been removed and replaced with first electrical connector 112 which is connected to electrical cable 116 which is connected to an electric submersible pump (not shown in the figure). Electrical connector 112 is removably sealed in the bottom of second vertical passageway 103 by fastener section 118 which holds seal members 119 which prevents leakage of fluid from the wellhead into passageway 103. Fastener section 118 is an integral part of electrical connector 112. Upper plug assembly 108 of FIG. 7 has been removed and replaced with second electrical connector 113 which is connected to electrical power line 114. Electrical connector 113 is removably sealed in the top of second vertical passageway 103 by fastener section 115 which holds seal members 119 which prevents leakage from the outside into passageway 103. Fastener section 115 is an integral part of electrical connector 113. Valve 117 has been installed in passageway 110 for sampling or detecting any gas in second vertical passageway 103. FIG. 10 is a detail of the top portion of the unitary diversionary-tubing hanger of FIG. 9 taken through line 10—10 to show bores 70.

Figure 11:
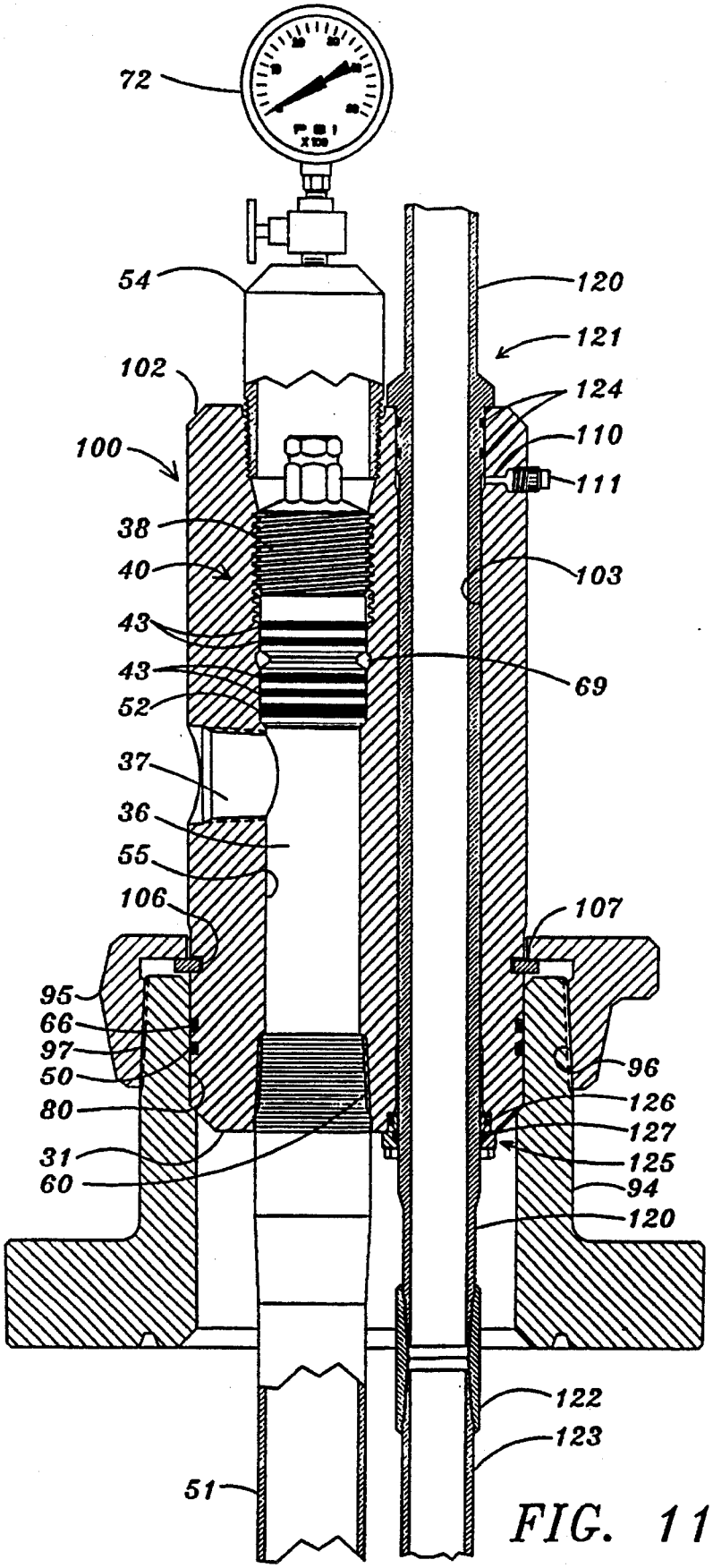

FIG. 11 illustrates yet another usage of embodiment 100 of the unitary diversionary-tubing hanger in wellhead 94 which is shown completed for water flood or closed system single hydraulics production. A fluid conducting tubing mandrel 120 is shown installed in second vertical passageway 103 with the upper end of mandrel 120 connected to fluid supply (not shown in the figure). Tubing mandrel 120 is removably sealed in the top of second vertical passageway 103 by fastener section 121 which holds seal members 124 which prevents leakage from the outside environment into passageway 103. Fastener section 121 is an integral part of tubing mandrel 120. Tubing mandrel 120 is removably sealed in the bottom of second vertical passageway 103 by removable fastener member 125 which holds seal members 126 and 127 which prevents leakage of fluid from the wellhead into passageway 103. The lower end of tubing mandrel 120 connected to coupling 122, which is connected to injection string 123, which is deployed in a predetermined location in the subterranean formation being treated or produced. Passageway 110 is shown sealed with plug 111 for this usage.

Figures 12, 13:
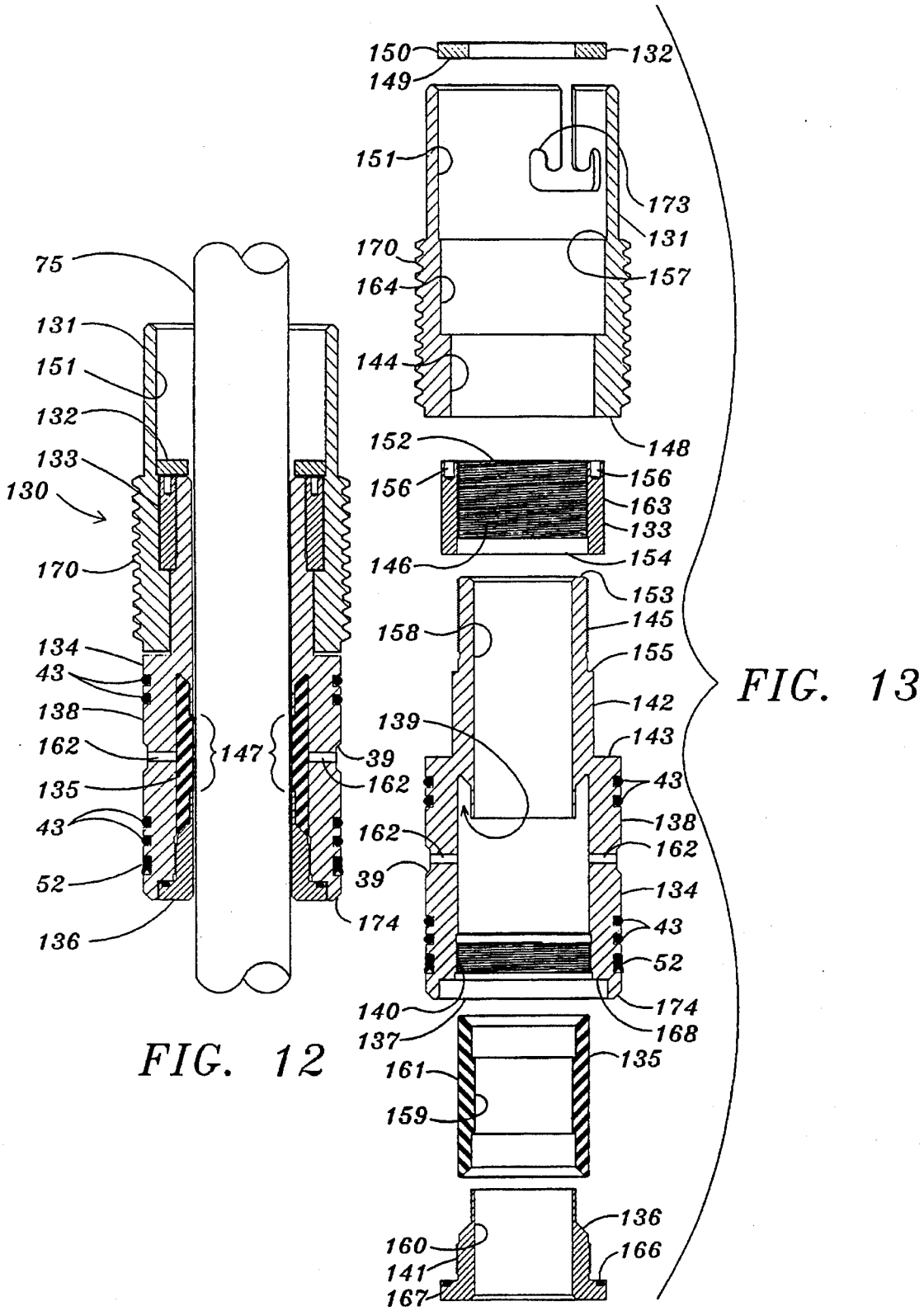

FIG. 12 is an illustration of one embodiment of an emergency retrievable, non-rotating, vertical rod seal 130 with an energizable seal member. FIG. 13 is an explosive view of the component parts of rod seal 130 shown surrounding, but spaced away from, polished pump rod 75. From FIGS. 12 and 13 it can be seen that rod seal 130 comprises first annular member 131, second annular member 132, third annular member 133, fourth annular member 134, energizable resilient seal member 135, and fifth annular member 136. Member 134 has an inner annular recess or seal cavity 139 for receiving energizable seal member 135, and internally threaded section 140, located somewhat above its bottom 137, for screwing externally threaded section 141 of member 136 into thereby securing seal member 135 in recess 139 and between members 134 and 136. O-ring seal 166 on flanged section 167 of member 136 abuts recessed surface 168 of member 134 thereby providing sealing means for preventing fluid communication between members 134 and 136.

Member 134 contains intermediate outside diameter section 142 and shoulder 143 adapted to rotatably receive smaller bore section 144 of member 131. Clearance is provided between the cylindrical surfaces of sections 142 and 144 to permit free rotation therebetween. Member 134 also contains smaller outside diameter externally threaded section 145 upon which internally threaded section 146 of member 133 can be screwed, thereby allowing members 131 and 134 to be connected together in non-binding rotatable relationship due also, in part, to clearance between bottom 148 of member 131 and shoulder 143 of member 134. Member 132 has an outside diameter 150 adapted for force fitting into upper larger bore section 151 of member 131. When member 132 is force fitted into bore section 151, member 132 prevents members 133 and 134 from unscrewing from each other. Member 134 also contains cylindrical section 138 that has circumferential groves for holding seals 43 and 52 described in earlier mentioned embodiments.

To assemble, bore 144 of member 131 is inserted onto section 142 of member 134. Then member 133 is screwed onto internally threaded section 145 of member 134 until bottom 154 of member 133 abuts shoulder 155 of member 134. Spanner wrench holes 156 are provided to facilitate the assembly process. Then member 132 is driven down into bore 151 of member 131 until bottom 149 of member 132 abuts shoulder 157 of member 131. Shoulder 157 is positioned within member 131 so that, when the components are thusly assembled, there is clearances between top 152 of member 133 and bottom 149 of member 132, between top 153 of member 134 and bottom 149 of member 132 and between cylindrical surfaces 163 of member 133 and 164 of member 131.

As shown in FIG. 12, a clearance is also provided between polished pump rod 75 and bore 158 of member 134, inside diameter 159 of seal member 135, and bore 160 of member 136 so that there is no wear on seal member 135 caused by rod movement until seal member 135 is energized. Seal member 135 can be energized by pressurizing its outside diameter 161. Small laterally extending holes 162 in member 134 communicate pressure to energize seal member 135 thereby displacing it radially inwardly through circumferential opening 147, formed by the inner gap between assembled members 134 and 136, and against polished pump rod 75.

Other features of rod seal 130 are externally threaded section 170 of member 131 which permit recoverable energizable vertical rod seal 130 to be screwed into internally threaded section 38 of the several previously described embodiments of the unitary diversionary-tubing hangers of this invention, O-ring seals 43, lip-type seal 52, inverted T-slot 173 which permits rod seal 130 to be retrieved from the unitary diversionary-tubing hanger with a conventional wellhead tool (not shown in the figure), and bottom seating surface 174 which permits seal 130 to be seated on seating surface 57 of rigid bodies 32 and 102.

Figure 14:
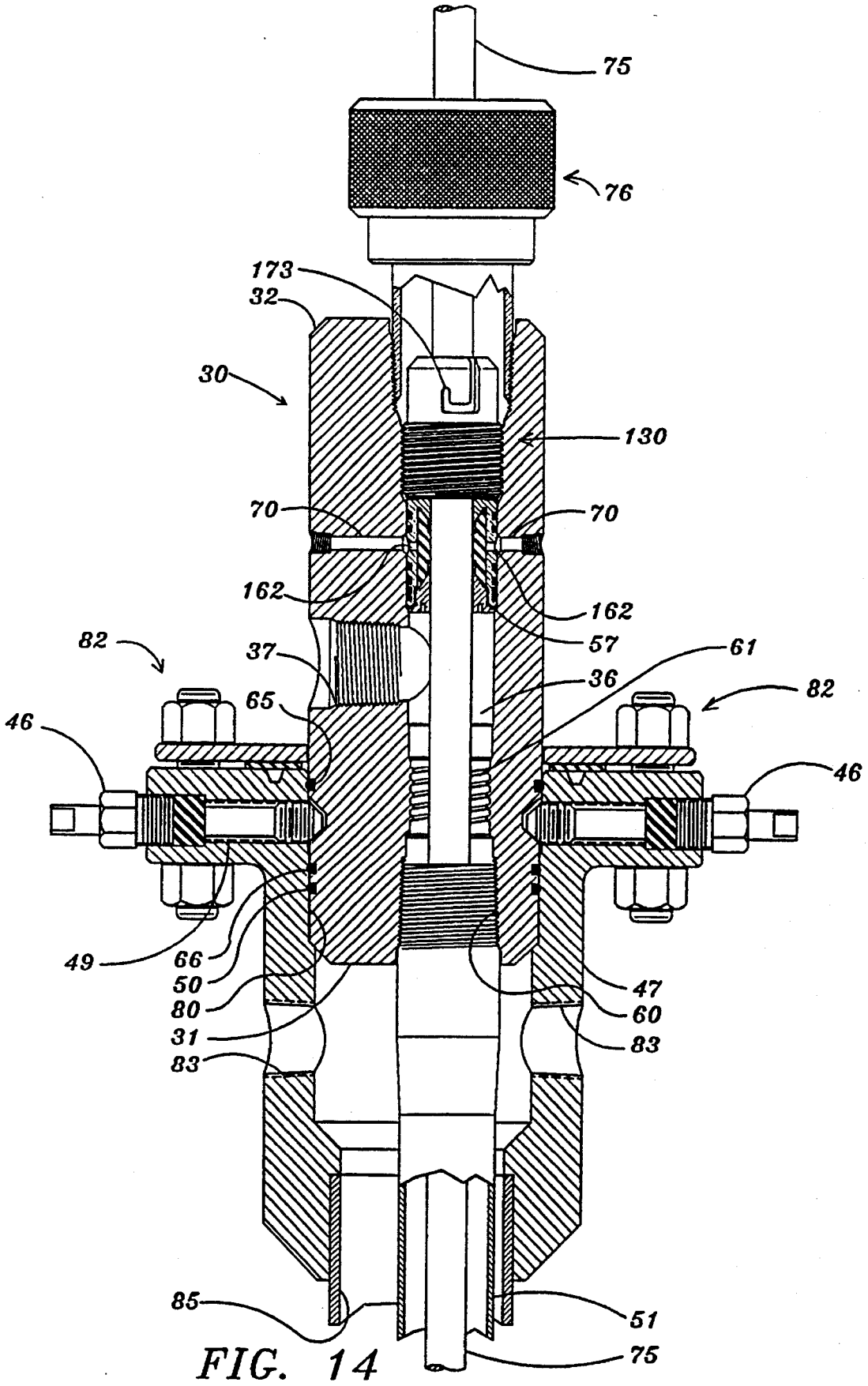
Figures 15, 16:
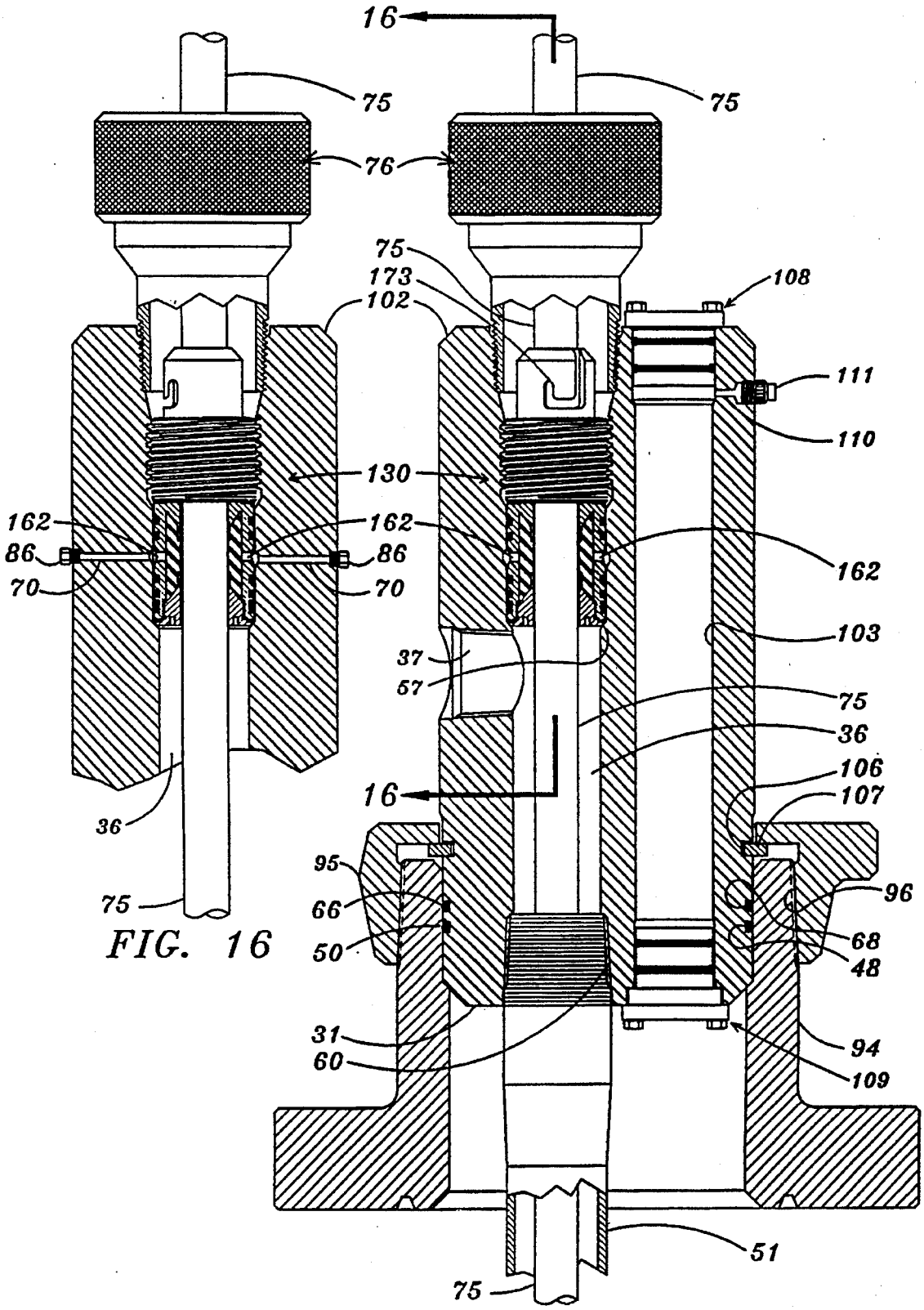

Rod seal 130 can be used in the rod pump completions shown in FIGS. 2, 7, and 8, previously described, and with similar uses as shown in FIG. 14 and 15.

FIG. 14 illustrates usage of embodiment 30 of unitary diversionary-tubing hanger of FIG. 1 in tubing head 47 completed for reciprocating or rotating rod pump production using retrievable non-rotating vertical rod seal 130 with energizable seal member 135 of FIG. 12. Although shown with internally threaded section 61, it is to be understood that section 61 is an optional feature and can be omitted from the unitary diversionary-tubing hanger if desired.

FIGS. 15 and 16 illustrates usage of embodiment 100 of unitary diversionary-tubing hanger similar to that of FIG. 7, in wellhead 94 completed for reciprocating or rotating rod pump production using retrievable non-rotating vertical rod seal 130 with energizable seal member 135 of FIG. 12 with second vertical passageway 103 being plugged as described in the discussion of FIG. 7.

Referring to FIGS. 14 and 16, seal member 135 can be pressurized by a pressurized fluid, gas or liquid, through small laterally extending passageways 70 in the unitary diversionary-tubing hanger, then around circumferential grove 39 of member 134 and through small laterally extending passageways 162 in member 134 of rod seal 130. Such pressurization can be automated so that if a leak is detected from packing gland 76 or from passageways 70, seal 130 is automatically pressurized thereby terminating the leak from such areas.

One advantage of completions using the unitary diversionary-tubing hanger of this invention and that described in my previous U.S. Pat. No. 4,804,045, is that there are no valves between production port 37 and tubing 51. However, the unitary diversionary-tubing hangers of this invention do not require two separate pieces as is required in my aforementioned patent. In other words, this invention requires only unitary diversionary-tubing hanger whereas the invention described in my U.S. Pat. No. 4,804,045 required a separate diversionary spool assembly to be coupled to a separate member or members for hanging the tubing. The saving by using the unitary diversionary-tubing hanger of this invention rather than the two pieces required by U.S. Pat. No. 4,804,045, is believed to be from about 55 to 75% in hardware cost plus the additional savings in manpower required to install one piece rather than two or more pieces.

The following are the steps required to complete a tubing head using the diversionary spool assembly ("DSA") of U.S. Pat. No. 4,804,045.

1. Run tubing in wellhead through blowout protector ("BOP"), and set tubing plug if necessary.
2. Run tubing with tubing hanger until tubing hanger has landed in tubing head.
3. Lock tubing in with lock set screws or other locking means.
4. Remove BOP.
5. Install seal sub or transition sleeve.
6. Install DSA.
7. Connect all interconnecting lines to DSA.
8. Remove tubing plug, install vertical seal plug and safety secondary backup seal.

Whereas, the following are the steps required to complete a tubing head using the unitary diversionary-tubing hanger of this invention.

1. Run tubing in wellhead through BOP, and set tubing plug if necessary.
2. Land the unitary diversionary-tubing hanger in tubing head.
3. Lock the unitary diversionary-tubing hanger in tubing head.
4. Remove BOP.
5. Connect all interconnecting lines to unitary diversionary-tubing hanger.
6. Remove tubing plug, install vertical seal plug and safety secondary backup seal.

As can be seen from the above example, both time and material are save by using the unitary diversionary-tubing hanger of this invention instead of the DSA of my U.S. Pat. No. 4,804,045.

With the unitary diversionary-tubing hangers of this invention and with the diversionary spool assembly of my U.S. Pat. No. 4,804,045, there are no valves in the vertical flow path, i.e. vertical passageway 36, of a well completed for production or injection. The vertical seal plug remains in place 100% of the time during the full production/injection mode. Accordingly, the vertical seal plug re-directs fluid flow from the vertical path to the horizontal path if in the production mode and from the horizontal path downward to the vertical path if in the injection mode. In either case, the vertical seal plug can be reset in vertical passageway 36 as quickly and as easily as it can be retrieved, both of which can be performed through a single "standby", full opened valve with lubricator in less than about one hour.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. A removable energizable vertical rod seal for removable installation of a pump rod therethrough for use in a vertical passageway of a member connected to a wellhead, the removable energizable vertical rod seal comprising:

a separable first part comprising:

a first annular member having a top, a bottom, a first outer cylindrical section for removable installation in the vertical passageway of the member, and a first inner cylindrical section concentric with the first outer cylindrical section for removable installation of the pump rod therethrough, outer sealing means on the first outer cylindrical section for sealing the space between the separable first part and the vertical passageway of the member, a seating surface on the first annular member for seating on an opposing seating surface in the vertical passageway of the member, a seal cavity within the separable first part having a circumferential inner opening to the first inner cylindrical section, at least one laterally extending passageway from the first outer cylindrical section to the seal cavity, and removable energizable resilient inner sealing means housed in the seal cavity for sealing, when energized, the space between the separable first part and the pump rod installed therethrough; and a separable second part comprising:

a second annular member having a top, a bottom, a second outer cylindrical section for removable installation in the vertical passageway of the member, and a second inner cylindrical section concentric with the second outer cylindrical section for removable installation of the pump rod therethrough, means for rotatable attachment of the bottom of the separable second part to the top of the separable first part with concentric alignment of the first outer cylindrical section with the second outer cylindrical section, means, on the second outer cylindrical section, for removable attachment of the separable second part to the vertical passageway of the member, and means for removable attachment of a device to the top of the separable second part for facilitating removable installation of the removable energizable vertical rod seal into the vertical passageway of the member, whereby, when the removable energizable vertical rod seal is installed in the vertical passageway of the member, the separable first part is non-rotatably installed therein.

2. The removable energizable vertical rod seal of claim 1, wherein the outer sealing means comprises a circumferential groove on the first outer cylindrical section for retaining an O-ring seal.

3. The removable energizable vertical rod seal of claim 1, wherein the seal cavity has an elongated annular shape concentric with the first outer cylindrical section.

4. The removable energizable vertical rod seal of claim 1, wherein the removable energizable resilient inner sealing means has a shape designed to fill the seal cavity and the circumferential opening and to remain, until energized, spaced away from the pump rod.

5. The removable energizable vertical rod seal of claim 1, wherein the means for removable attachment of a device to the top of the separable second part is a inverted T-slot.

6. The removable energizable vertical rod seal of claim 1, wherein the first annular member comprises an upper member and a lower member which are removably joined and when separated provide access to the seal cavity, wherein the upper member comprises the first outer cylindrical section, the top, the outer sealing means, and the seating surface, and wherein the upper member and lower member are removably joined by an internally threaded section and an externally threaded section.

7. The removable energizable vertical rod seal of claim 6, wherein the upper member comprises the internally threaded section and the lower member comprises the externally threaded section, and further comprising sealing means for preventing fluid communication between the upper member and the lower member.

8. The removable energizable vertical rod seal of claim 1, wherein the means for removable attachment of the separable second part to the vertical passageway of the member is an externally threaded section.

9. The removable energizable vertical rod seal of claim 1, wherein the means for removable attachment of the separable second part to the vertical passageway of the member is a circumferential grove for receiving laterally extending locking screws deployed through the wellhead.

* * * * *